US011668229B1

(12) United States Patent
Lodge

(10) Patent No.: US 11,668,229 B1
(45) Date of Patent: Jun. 6, 2023

(54) ENGINE CRANK WITH AIR CHANNELS

(71) Applicant: Kenneth John Lodge, Irvine, CA (US)

(72) Inventor: Kenneth John Lodge, Irvine, CA (US)

( * ) Notice: Subject to any disclaimer, the term of this patent is extended or adjusted under 35 U.S.C. 154(b) by 0 days.

(21) Appl. No.: 17/835,846

(22) Filed: Jun. 8, 2022

(51) Int. Cl.
*F02B 33/24* (2006.01)
*F02B 33/30* (2006.01)
*F02B 75/02* (2006.01)

(52) U.S. Cl.
CPC ..... *F02B 33/24* (2013.01); *F02B 33/30* (2013.01); *F02B 75/02* (2013.01); *F02B 2075/025* (2013.01)

(58) Field of Classification Search
CPC ..... F02B 33/30; F02B 33/24; F02B 75/02; F02B 2075/025
See application file for complete search history.

(56) References Cited

U.S. PATENT DOCUMENTS 600,958 A * 3/1898 Vezin ..... F01M 1/06 55/441
964,637 A * 7/1910 Fornaca ..... F01M 1/06 123/196 R
2,090,589 A 8/1937 Burnish
2,270,077 A * 1/1942 Morris ..... F01M 1/06 184/6
2,347,521 A 4/1944 Steiger
5,285,752 A 2/1994 Reed
7,350,498 B2 * 4/2008 Matsuda ..... F01M 1/06 123/196 R
7,543,559 B2 6/2009 Milicic
7,905,205 B1 3/2011 Parris
11,255,374 B1 2/2022 van de Ven
2012/0137827 A1 6/2012 Osawa

FOREIGN PATENT DOCUMENTS

DE 4136331 5/1992
JP 55023379 2/1980
JP 2005-140170 6/2005

* cited by examiner

*Primary Examiner* — Kevin A Lathers
(74) *Attorney, Agent, or Firm* — Alonzo & Associates; Arlyn Alonzo

(57) ABSTRACT

Aspects of the disclosure are directed to an engine crank. In accordance with one aspect, the engine crank includes a first web, wherein the first web includes a first plurality of air channels, and a second web coupled to the first web, wherein the second web includes a second plurality of air channels.

20 Claims, 12 Drawing Sheets

ENGINE CRANK WITH AIR CHANNELS

TECHNICAL FIELD

This disclosure relates generally to the field of engine cranks, and, in particular, to engine cranks with air channels.

BACKGROUND

Efficiency in converting fuel chemical energy to useful mechanical energy is very important in an engine crank. Gasoline-powered internal combustion engines are used in many two cylinder engines. Internal combustion engines of various types and sizes propel vehicles along the roadways. An engine crank design that improves the efficiency of fuel chemical energy conversion may be desirable in economizing fuel consumption and/or engine performance.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

In one aspect, the disclosure provides an engine crank with air channels. Accordingly, an engine crank including: a first web, wherein the first web includes a first plurality of air channels, and a second web coupled to the first web, wherein the second web includes a second plurality of air channels. In one example, each of the first plurality of air channels is equidistant from one another, and wherein each of the second plurality of air channels is equidistant from one another. In one example, each of the first plurality of air channels includes a first length and a first uniform cross-sectional area throughout the first length. In one example, each of the second plurality of air channels includes a second length and a second uniform cross-sectional area throughout the second length.

In one example, each of the first plurality of air channels includes a first length and a first non-uniform cross-sectional area throughout the first length. In one example, each of the second plurality of air channels includes a second length and a second non-uniform cross-sectional area throughout the second length. In one example, the first non-uniform cross-sectional area is largest near an outer perimeter of the engine crank and smallest near a crank axis. In one example, the second non-uniform cross-sectional area is largest near an outer perimeter of the engine crank and smallest near a crank axis.

In one example, each of the first plurality of air channels includes a cross-sectional area of one of the following: a square, a rectangle, a circle or an oval. In one example, each of the second plurality of air channels includes a cross-sectional area of one of the following: a square, a rectangle, a circle or an oval.

In another aspect, a two-stroke engine, including: a piston; a combustion chamber configured to house the piston; an engine crank, wherein the engine crank is coupled to the piston; and an engine crank chamber configured to house the engine crank; and wherein the engine crank comprises: a first web, wherein the first web includes a first plurality of air channels, and a second web coupled to the first web, wherein the second web includes a second plurality of air channels.

In one example, each of the first plurality of air channels is equidistant from one another, and wherein each of the second plurality of air channels is equidistant from one another. In one example, each of the first plurality of air channels includes a first length and a first uniform cross-sectional area throughout the first length. In one example, each of the second plurality of air channels includes a second length and a second uniform cross-sectional area throughout the second length.

In one example, each of the first plurality of air channels includes a first length and a first non-uniform cross-sectional area throughout the first length. In one example, each of the second plurality of air channels includes a second length and a second non-uniform cross-sectional area throughout the second length. In one example, the first non-uniform cross-sectional area is largest near an outer perimeter of the engine crank and smallest near a crank axis. In one example, the second non-uniform cross-sectional area is largest near an outer perimeter of the engine crank and smallest near a crank axis. In one example, each of the first plurality of air channels includes a cross-sectional area of one of the following: a square, a rectangle, a circle or an oval. In one example, each of the second plurality of air channels includes a cross-sectional area of one of the following: a square, a rectangle, a circle or an oval.

These and other aspects of the present disclosure will become more fully understood upon a review of the detailed description, which follows. Other aspects, features, and implementations of the present disclosure will become apparent to those of ordinary skill in the art, upon reviewing the following description of specific, exemplary implementations of the present invention in conjunction with the accompanying figures. While features of the present invention may be discussed relative to certain implementations and figures below, all implementations of the present invention can include one or more of the advantageous features discussed herein. In other words, while one or more implementations may be discussed as having certain advantageous features, one or more of such features may also be used in accordance with the various implementations of the invention discussed herein. In similar fashion, while exemplary implementations may be discussed below as device, system, or method implementations it should be understood that such exemplary implementations can be implemented in various devices, systems, and methods.

DETAILED DESCRIPTION

Figure 1:
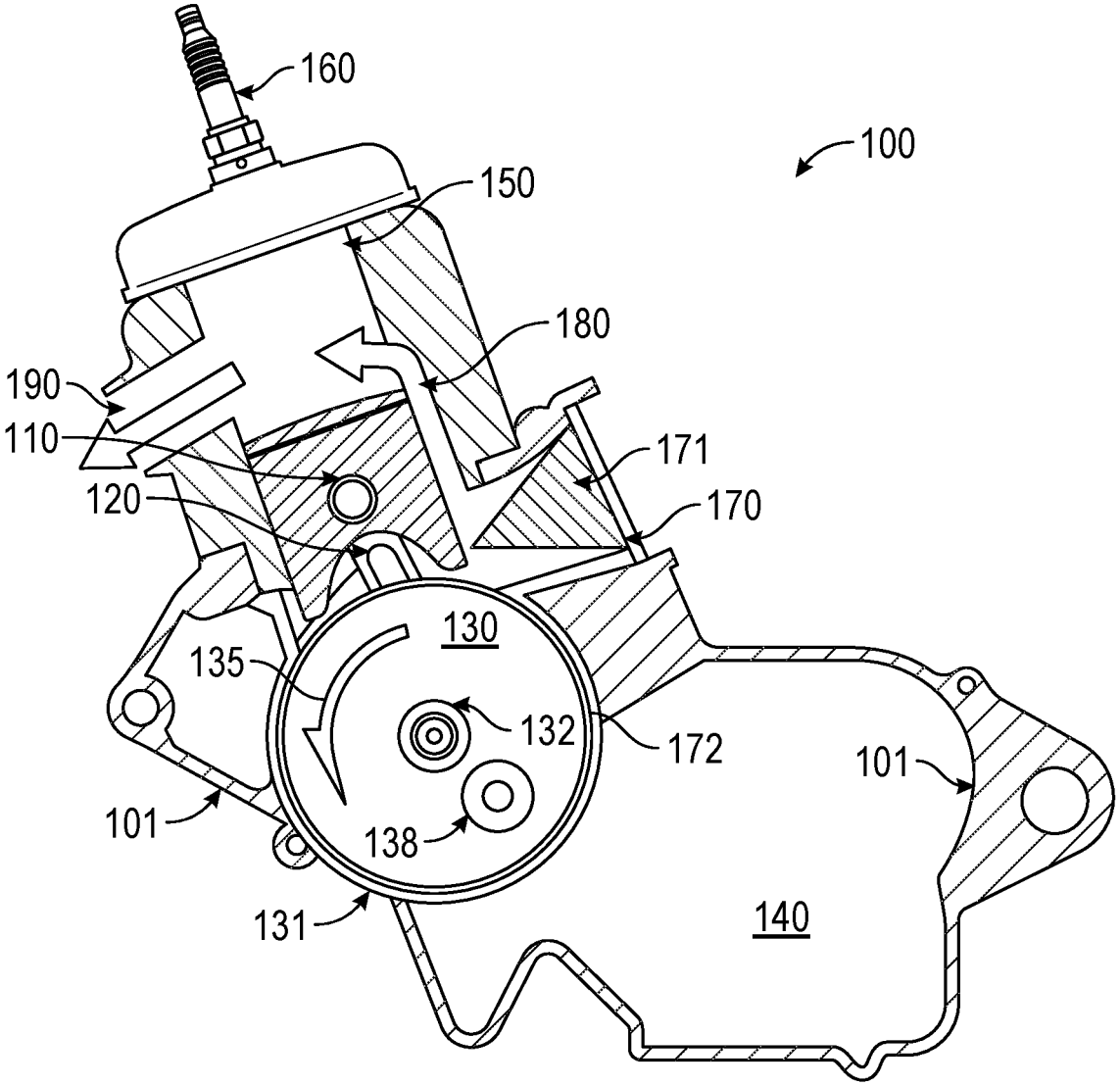
FIG. 1 PRIOR ART
FIG. 1 illustrates an example of a two-stroke engine.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While for purposes of simplicity of explanation, the methodologies are shown and described as a series of acts, it is to be understood and appreciated that the methodologies are not limited by the order of acts, as some acts may, in accordance with one or more aspects, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with one or more aspects.

There are four-stroke engines and two-stroke engines. The number of strokes per cycle is related to the piston movements per cycle. Many motorcycles and other small equipment operate with two-stroke engines. The two-stroke engine may include two steps in a cycle: a compression stroke and a power stroke. The two-stroke engine is a heat engine which relies on periodic combustion of the gasoline (i.e., fuel) and air mixture in an enclosed space within the two-stroke engine to convert chemical energy in the fuel to linear motion (i.e., mechanical energy).

For example, in a cycle, linear motion of a piston within a cylinder of the two-stroke engine is translated into rotational motion of the engine crank. In one example, one cycle represents one complete revolution of 360 degrees of the engine crank by the piston. In one example, during the compression stroke, the cylinder pressure increases as the volume of the fuel/air mixture is compressed. As the piston moves upwards, the fuel/air mixture is ignited by a spark plug to induce combustion. In one example, during the power stroke, the cylinder pressure decreases after combustion, and the piston moves downwards.

In one example, chemical energy is converted to mechanical energy as a result of the combustion. This is achieved, for example, through the piston movement during the compression stroke (i.e., one upward movement) and the power stroke (i.e., one downward movement), the engine crank rotates one revolution per cycle.

In one example, the fuel/air mixture enters the engine through an intake port and exhaust gases from the combustion exit through an exhaust port. In one example, the intake port and the exhaust port are on opposite sides of the engine. In one aspect, the engine crank may include additional air channels for movement of air throughout the cylinder.

FIG. 1 illustrates an example of a two-stroke engine 100. In one example, an engine casing 101 encloses the two-stroke engine 100. In the example illustrated, the two-stroke engine 100 also includes a combustion chamber 150, a gearbox chamber 140, an engine crank 130, a piston 110 and a connecting rod 120. In the example, below the engine crank 130 is the gearbox chamber 140 which is also surrounded by engine casing 101. In one example, an engine crank chamber 131 may enclose the engine crank 130. In the example of FIG. 1, the connecting rod 120 connects the piston 110 to the engine crank 130. And, the linear (e.g., vertical) motion of the piston 110 is converted into rotational motion of the engine crank 130 through the movement of the connecting rod 120.

In one example, air/fuel mixture 171 is introduced into the engine crank 130 via a reed valve 170. For example, flow of the air/fuel mixture 171 may be regulated by a carburetor (not shown) or a fuel injector (not shown) prior to introducing the air/fuel mixture 171 via the reed valve 170. For example, the air/fuel mixture 171 may utilize gasoline as a fuel for a gasoline-powered engine. For example, the engine crank 130 may include a crank axis 132 and a crank pin 138. In one example, the crank pin 138 is the termination of the connecting rod 120. The crank axis 132 is an axis of rotation for the engine crank 130. In one example, the crank axis 132 protrudes from the center of the engine crank 130.

The arrow 135 in FIG. 1 shows the engine crank 130 rotating in a counter-clockwise direction around the crank axis 132. In one example, the motion of the piston 110 (upward and downward) is coupled to the connection rod 120 which drives the rotation of the engine crank 130. The rotation of the engine crank 130 propels the air/fuel mixture 171 from the reed valve 170 to the engine crank chamber 131. In one example, as the engine crank 130 rotates in the counter-clockwise direction, the air/fuel mixture 172 is compressed. The compressed air/fuel mixture 172 traverses an inlet/transfer port 180 and enters the combustion chamber 150 of the engine 100. For example, during the compression stroke, the volume of the compressed fuel/air mixture 172 is compressed further as piston 110 moves upwards. And, the compressed fuel/air mixture 172 is ignited by a spark plug 160 at the end of the compression stroke to produce combustion products. During the power stroke, energy from the combustion propels the piston 110 downwards and exhaust gases are emitted through an exhaust port 190.

In one example, the engine 100 converts stored fuel chemical energy to mechanical energy in a two-stroke process using the piston 110, the connecting rod 120 and the engine crank 130. Performance of the engine may be quantified by performance metrics such as tractive force and power. In one example, tractive force (i.e., lateral force) may be expressed in kilograms (kg), newtons (N) or pounds (lb). In one example, power (i.e., time derivative of work) may be measured in horsepower (hp), watts (W) or joules per sec (J/s).

Figure 2:
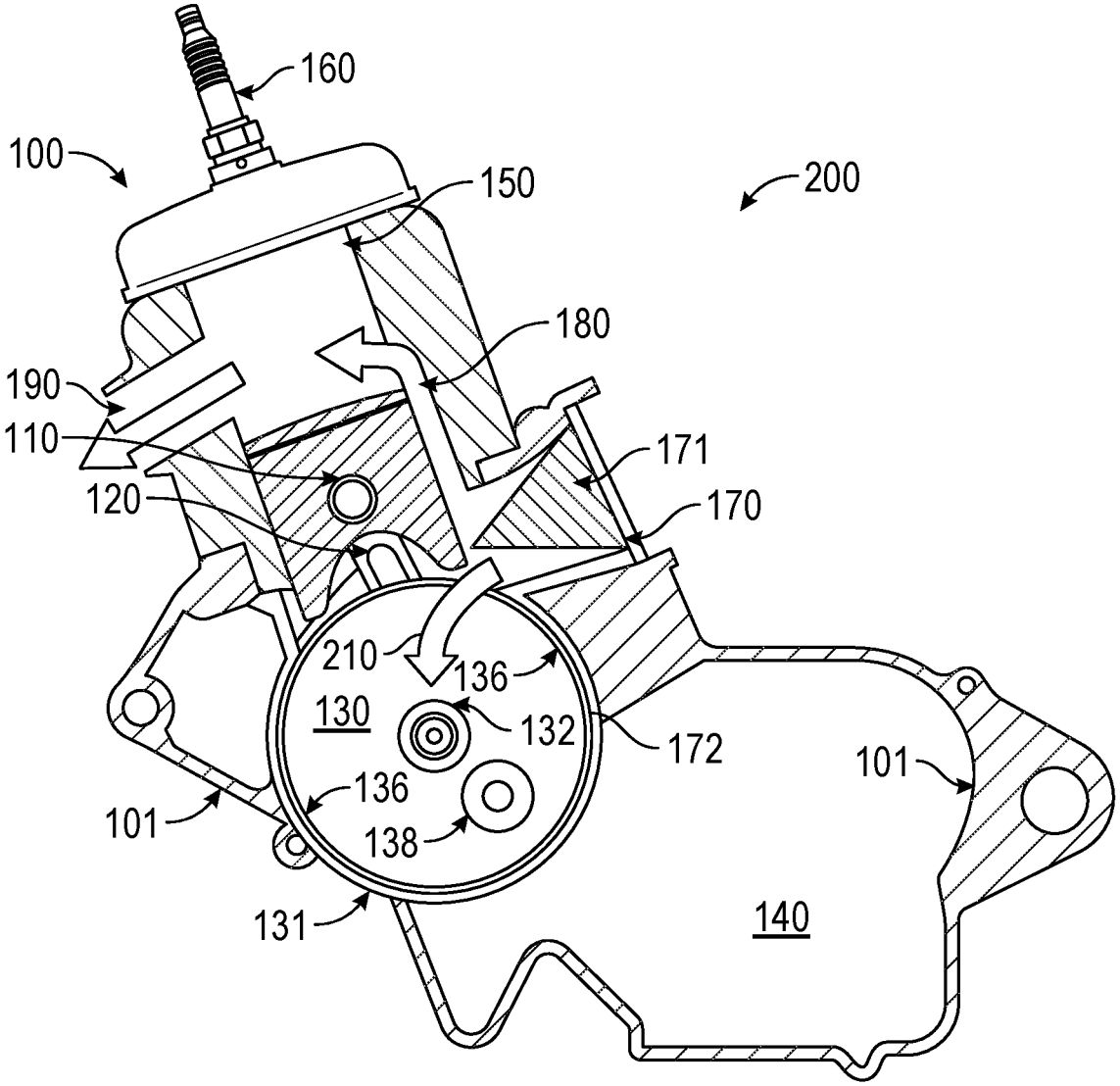
FIG. 2 PRIOR ART
FIG. 2 illustrates an example indication of air flow of the example two stroke engine of FIG. 1.

In one aspect, engine performance may be improved by modification of the engine crank 130 within the engine 100. FIG. 2 illustrates an example indication of air flow 200 of the example two stroke engine 100 of FIG. 1. The arrow 210 indicates that air flow is pulled to a lower pressure at the center of the engine crank 130. And, there is high pressure compression against the engine crank wall 136 due to restrictive air flow during the rotation of the engine crank 130.

Figure 3:
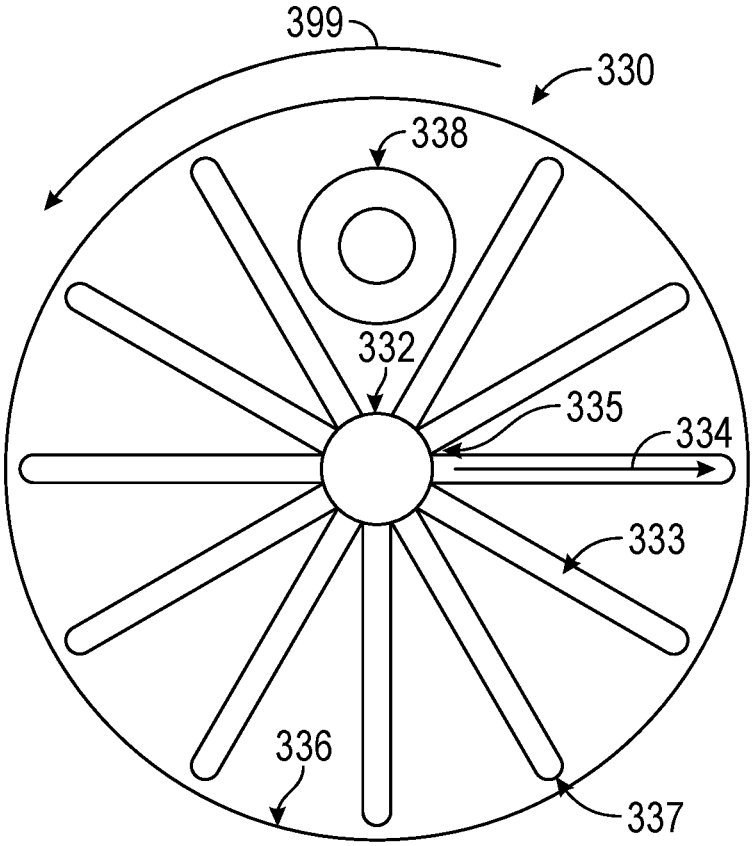
FIG. 3 illustrates a circumferential view of a first example of an engine crank in accordance with the present disclosure.

FIG. 3 illustrates a circumferential view of a first example of an engine crank 330 in accordance with the present disclosure. Illustrated in FIG. 3 are a crank pin 338, and a crank axis 332 which protrudes from the center of the engine crank 330. In one example, the engine crank 330 includes a plurality of air channels 333. The direction of air flow in the air channels 333 is shown by the arrow 334. FIG. 3 illustrates low pressure port inlet 335 located near the center of the engine crank 330 and high pressure port exit 337 located near the crank wall 336. One skilled in the art would understand that, although the low pressure port inlet 335 is illustrated as a single point in FIG. 3, the low pressure area is located substantially around the center of the engine crank 330. One skilled in the art would understand that, although the high pressure port exit 337 is illustrated as a single point in FIG. 3, the high pressure area is located near a substantial portion of the crank wall 336.

Arrow 399 indicates the rotational direction of the engine crank 330. In one example, the air channel 333 has a cross-sectional area of a square, a rectangle, a circle or an oval. In one example, the cross-sectional area is uniform throughout the length of the air channel. In one example the air channels 333 are spaced radially equidistant from one another. In the alternative, the air channels 333 are not spaced radially equidistant from one another. In one example, the air channel 333 extends from near the crank axis 332 to the crank wall 336. In another example, one end of the air channel 333 does not extend all the way to the crank axis 332 while the other end of the air channel 333 extends to the crank wall 336.

Figure 4:
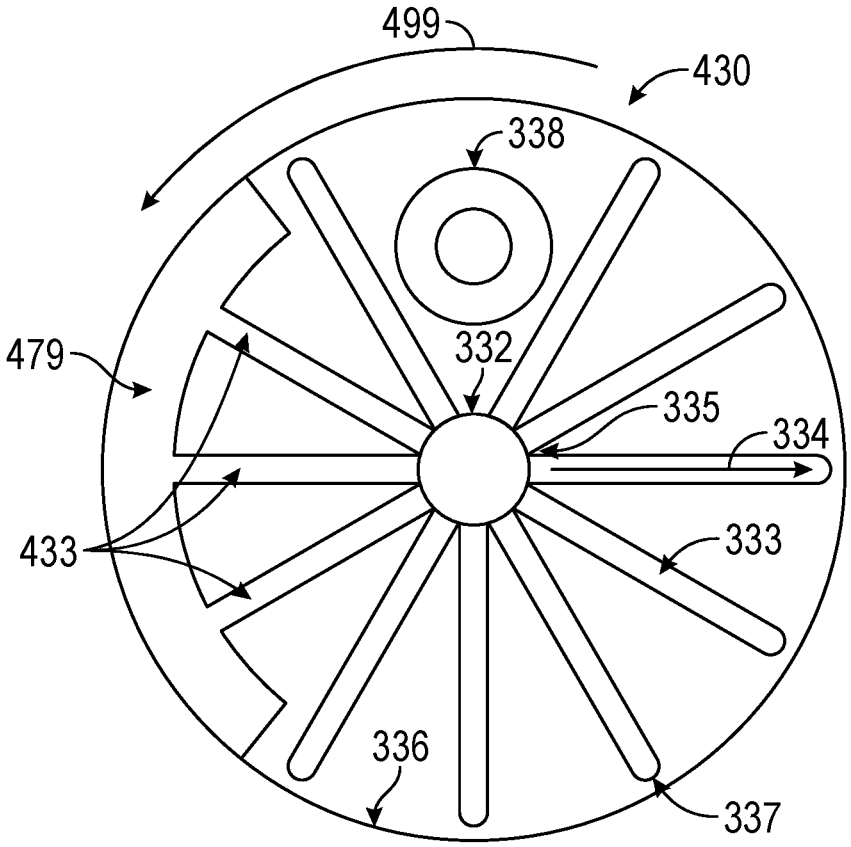
FIG. 4 illustrates a circumferential view of a second example of an engine crank in accordance with the present disclosure.

FIG. 4 illustrates a circumferential view of a second example of an engine crank 430 in accordance with the present disclosure. The components (i.e., the crank pin 338, the crank axis 332, the air channels 333, low pressure port inlet 335, the crank wall 336, high pressure port exit 337) shown as part of the engine crank 430 of FIG. 4 are the same as the components of the engine crank 330 of FIG. 3. The engine crank 430 includes a plurality of air channels 333 that extends from near the crank axis 332 to near the crank wall 336 and at least one shortened air channel 433. As shown in FIG. 4, the shortened air channel 433 extends from near the crank axis 332 to a location of the engine crank 430 away from the crank wall 336. In one example, the shortened air channel 433 terminates one of its ends at a crank web chamber 479. In one example, the engine chamber 479 occupies only a portion of the circumference of the engine crank 430. One skilled in the art would understand that the size of the portion of the circumference of the engine crank 430 that the crank web chamber 479 occupies may vary. In one example, all the shortened air channel 433 terminates one of its ends at a crank web chamber 479.

That is, the shortened air channel 433 does not extend all the way to the crank wall 336. In one example, one end of the shortened air channel 433 does not extend all the way to the crank axis 332; that is, the shortened air channel 433 does not extend the length of a radius measured from the crank axis 332 to the crank wall 336.

In one example, the engine crank 430 includes an X quantity of air channels 333 and a Y quantity of shortened air channels 433 such that the total quantity (i.e., X+Y) is the same as the total quantity of air channels 333 in the engine crank 330 of FIG. 3. In another example, the engine crank 430 may include one or more shortened air channels 433 (i.e., Y quantity) such that the total quantity (i.e., X quantity of air channels 333+Y quantity of shortened air channels 433) is greater than the total quantity of air channels 333 in the engine crank 330 of FIG. 3. In yet another example, the engine crank 430 may include one or more shortened air channels 433 (i.e., Y quantity) such that the total quantity (i.e., X quantity of air channels 333+Y quantity of shortened air channels 433) is smaller than the total quantity of air channels 333 in the engine crank 330 of FIG. 3.

In one example, the engine crank 430 includes an X quantity of air channels 333 that is larger than a Y quantity of shortened air channels 433. In another example, the engine crank 430 includes an X quantity of air channels 333 that is smaller than a Y quantity of shortened air channels 433. In yet another example, the engine crank 430 includes a Z quantity of air channels 333 and a Z quantity of shortened air channels 433 so that the quantity of air channels 333 and the quantity of shortened air channels 433 are the same.

In one example, the shortened air channel 433 has a cross-sectional area of a square, a rectangle, a circle or an oval. In one example, the cross-sectional area is uniform throughout the length of the air channel. In one example the air channels 333 and the shortened air channels 433 are spaced radially equidistant from one another. In the alternative, the air channels 333 and the shortened air channels 433 are not spaced radially equidistant from one another. Arrow 499 indicates the rotational direction of the engine crank 430.

Figure 5A:
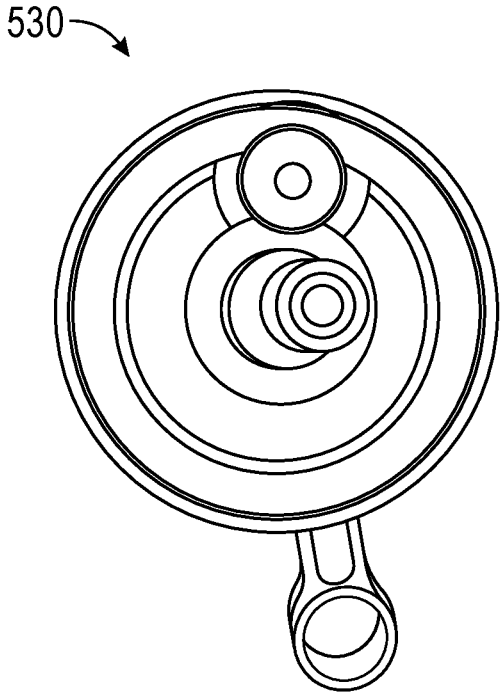
FIG. 5 illustrates three views (view 5A, view 5B, view 5C) of an example engine crank.
Figure 5B:
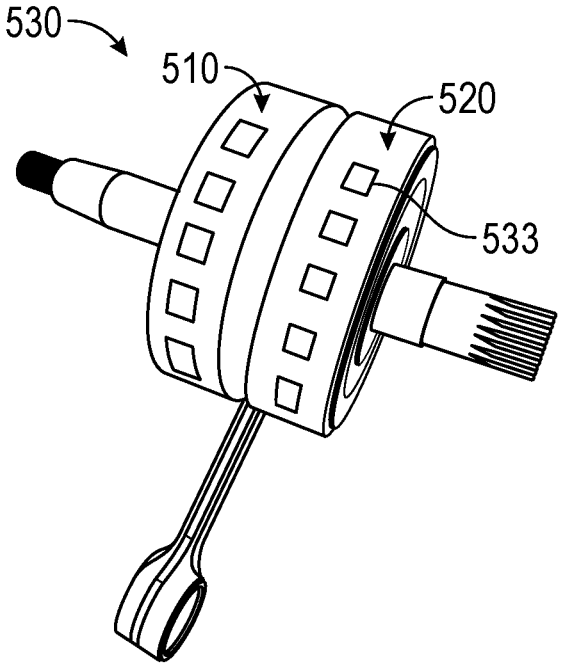
Figure 5C:
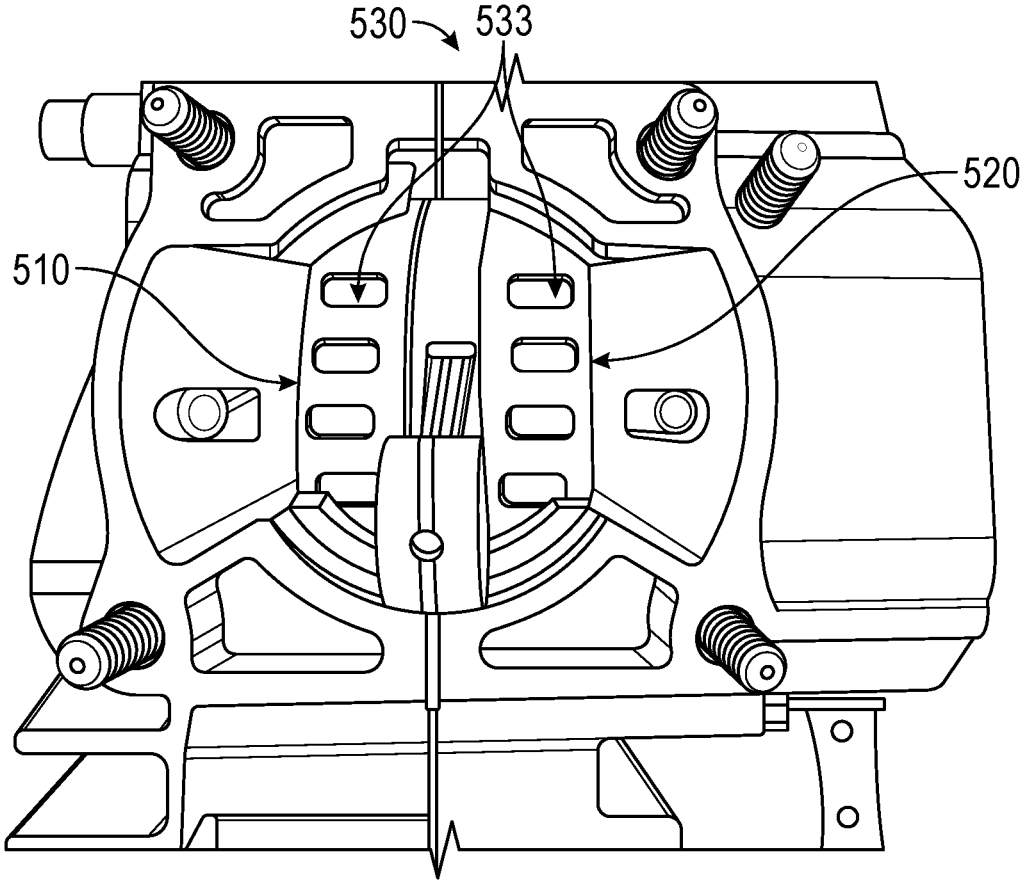

FIG. 5 illustrates three views (view 5A, view 5B, view 5C) of an example engine crank 530. In FIG. 5, view 5A is a side view of the engine crank 530. In FIG. 5, view 5B is a perspective top view of the engine crank 530. Shown in view 5B are a plurality of air channels 533 on each of the two half engine cranks 510, 520. In the example shown in view 5B, the cross-sectional area of the air channels is a square. In one example, the engine crank 530 includes two half engine cranks 510, 520 (as shown in view 5B) with identical rotations and displaced from each other by a gap. In one example, each half-crank is referred to as a web. In FIG. 5, view 5C is a bottom view of the engine crank 530. In the example shown in view 5C, the cross-sectional area of the air channels is a rectangle.

Figure 6:
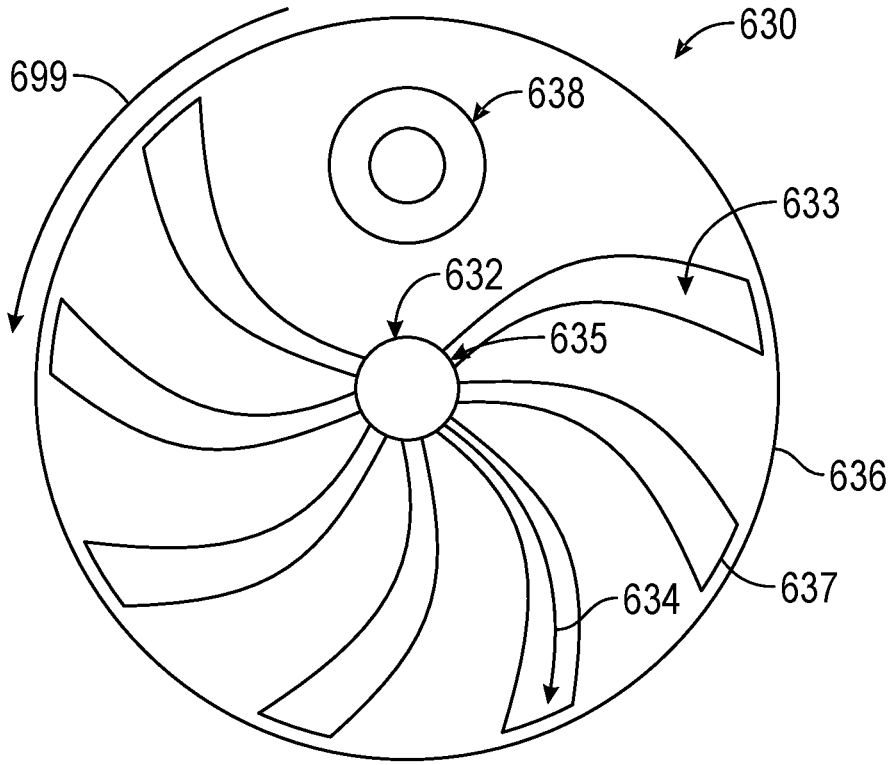
FIG. 6 illustrates a circumferential view of a third example of an engine crank in accordance with the present disclosure.

FIG. 6 illustrates a circumferential view of a third example of an engine crank 630 in accordance with the present disclosure. Illustrated in FIG. 6 are a crank pin 638 and a crank axis 632 which protrudes from the center of the engine crank 630. In one example, the engine crank 630 includes a plurality of non-uniform air channels 633. The direction of air flow in the non-uniform air channels 633 is shown by the arrow 634.

FIG. 6 illustrates low pressure port inlet 635 located near the center of the engine crank 630 and high pressure port exit 637 located near the crank wall 636. One skilled in the art would understand that, although the low pressure port inlet 635 is illustrated as a single point in FIG. 6, the low pressure area is located substantially around the center of the engine crank 630. One skilled in the art would understand that, although the high pressure port exit 637 is illustrated as a single point in FIG. 6, the high pressure area is located near a substantial portion of the crank wall 636.

Arrow 699 indicates the rotational direction of the engine crank 630. In one example, the non-uniform air channel 633 has a non-uniform cross-sectional area. For example, the cross-sectional area of the non-uniform air channel 633 is the largest near the outer perimeter of the engine crank 630 and smallest near the crank axis 632. In one example, the differential area of the cross-sectional area of the non-uniform air channel 633 varies in a continuous manner.

In one example, the air channel 633 extends from near the crank axis 632 to the crank wall 636. In another example, one end of the air channel 633 does not extend all the way to the crank axis 632 while the other end of the air channel 633 extends to the crank wall 636.

Figure 7:
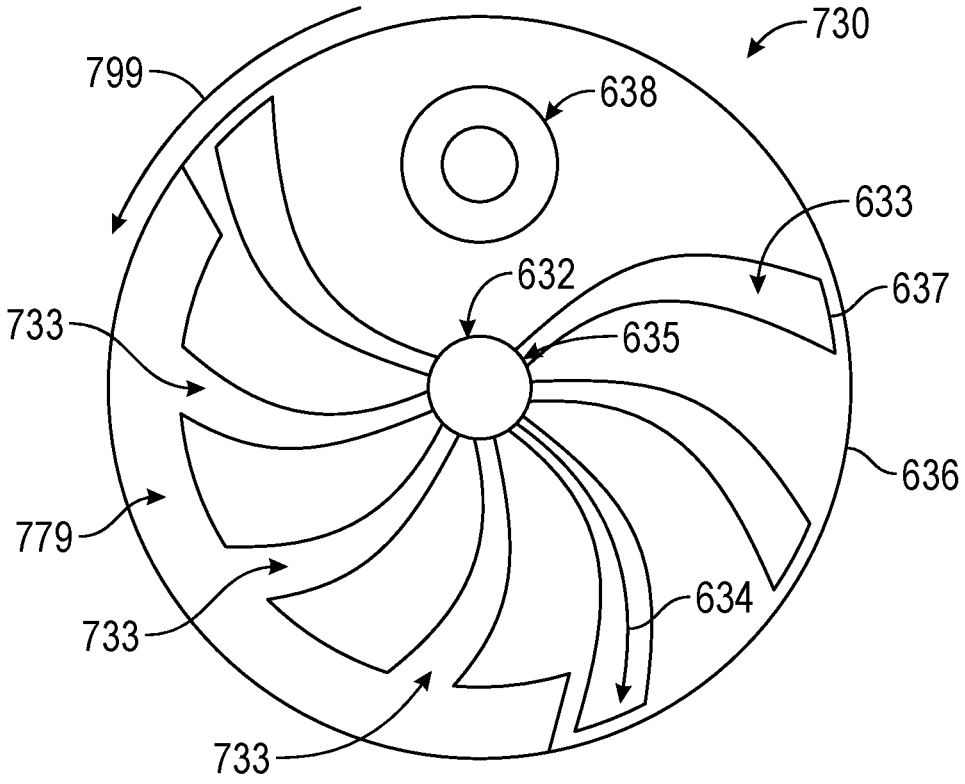
FIG. 7 illustrates a circumferential view of a fourth example of an engine crank in accordance with the present disclosure.

FIG. 7 illustrates a circumferential view of a fourth example of an engine crank 730 in accordance with the present disclosure. The components (i.e., the crank pin 638, the crank axis 632, the non-uniform air channels 633, low pressure port inlet 635, the crank wall 636, high pressure port exit 637) shown as part of the engine crank 730 of FIG. 7 are the same as the components of the engine crank 630 of FIG. 6. The engine crank 730 includes a plurality of non-uniform air channels 633 that extends from near the crank axis 632 to near the crank wall 636 and at least one shortened non-uniform air channel 733. As shown in FIG. 7, the shortened non-uniform air channel 733 extends from near the crank axis 632 to a location of the engine crank 730 away from the crank wall 636. In one example, the shortened non-uniform air channel 733 terminates one of its ends at a crank web chamber 779. In one example, the crank web chamber 779 occupies only a portion of the circumference of the engine crank 730. One skilled in the art would understand that the size of the portion of the circumference of the engine crank 730 that the crank web chamber 779 occupies may vary. In one example, all the shortened air channel 733 terminates one of its ends at a crank web chamber 779.

That is, the shortened non-uniform air channel 733 does not extend all the way to the crank wall 636. In one example, one end of the shortened non-uniform air channel 733 does not extend all the way to the crank axis 632; that is, the shortened non-uniform air channel 733 does not extend the length of a radius measured from the crank axis 632 to the crank wall 636.

In one example, the engine crank 730 includes an A quantity of non-uniform air channels 633 and a B quantity of shortened non-uniform air channels 733 such that the total quantity (i.e., A+B) is the same as the total quantity of non-uniform air channels 633 in the engine crank 630 of FIG. 6. In another example, the engine crank 730 may include one or more shortened non-uniform air channels 733 (i.e., B quantity) such that the total quantity (i.e., A quantity of non-uniform air channels 633+B quantity of shortened non-uniform air channels 733) is greater than the total quantity of non-uniform air channels 633 in the engine crank 630 of FIG. 6. In yet another example, the engine crank 730 may include one or more shortened non-uniform air channels 733 (i.e., B quantity) such that the total quantity (i.e., A quantity of non-uniform air channels 633+B quantity of shortened non-uniform air channels 733) is smaller than the total quantity of non-uniform air channels 633 in the engine crank 630 of FIG. 6.

In one example, the engine crank 730 includes an A quantity of non-uniform air channels 633 that is larger than a B quantity of shortened non-uniform air channels 733. In another example, the engine crank 730 includes an A quantity of non-uniform air channels 633 that is smaller than a B quantity of shortened non-uniform air channels 733. In yet another example, the engine crank 730 includes a C quantity of non-uniform air channels 633 and a C quantity of shortened non-uniform air channels 733 so that the quantity of non-uniform air channels 633 and the quantity of shortened non-uniform air channels 733 are the same.

In one example, the shortened non-uniform air channel 733 has a cross-sectional area of a square, a rectangle, a circle or an oval. In one example the non-uniform air channels 633 and the shortened non-uniform air channels 733 are spaced radially equidistant from one another. In the alternative, the non-uniform air channels 633 and the shortened non-uniform air channels 733 are not spaced radially equidistant from one another. Arrow 799 indicates the rotational direction of the engine crank 730. In one example, the shortened non-uniform air channel 733 has a non-uniform cross-sectional area. For example, the cross-sectional area of the shortened non-uniform air channel 633 is the largest near the outer perimeter of the engine crank 730 and smallest near the crank axis 632.

In one example, an engine crank may include a mixture of one or more air channels each with cross-sectional area that is uniform throughout its length, and one or more air channels each with cross-sectional area that is non-uniform throughout its length. For example, an engine crank may include a mixture of one or more of the following: air channels 333 (as shown in FIG. 3) air channels 433 (as shown in FIG. 4), air channels 633 (as shown in FIG. 6) and/or air channels 733 (as shown in FIG. 7).

In one example, an engine crank may include air channels with different cross-sectional areas. For example, an engine crank may include one or more air channels with one or more of the following cross-sectional areas: a square, a rectangle, a circle and/or an oval. One skilled in the art would understand that the quantities of the various air channels shown (e.g., air channels 333 (as shown in FIG. 3) air channels 433 (as shown in FIG. 4), air channels 633 (as shown in FIG. 6) and/or air channels 733 (as shown in FIG. 7) is not limiting and that other quantities of air channels to be included in an engine crank are within the spirit and scope of the present disclosure.

Figure 8:
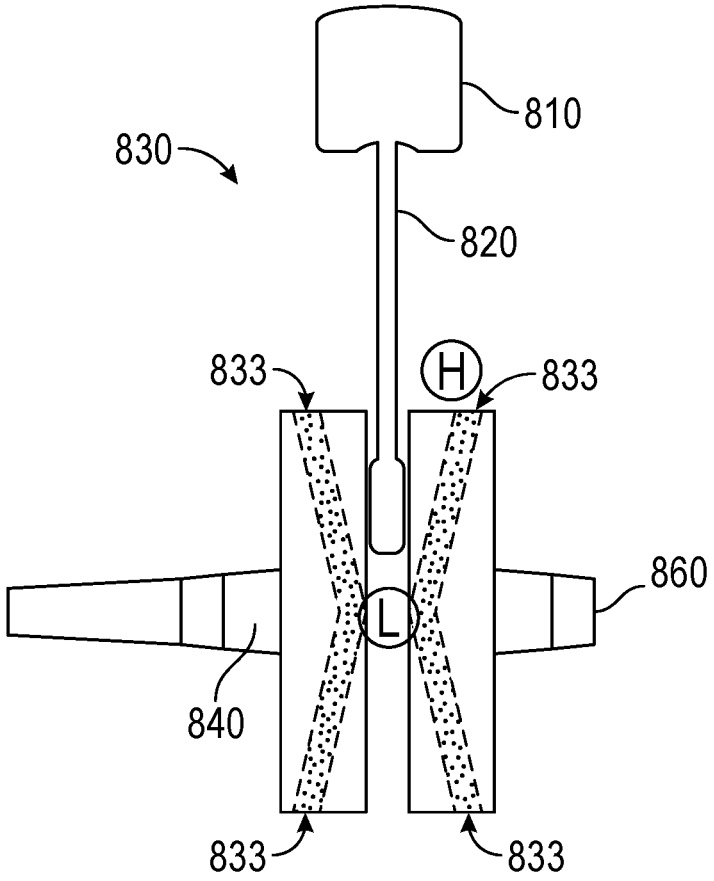
FIG. 8 illustrates an example of a partial engine crank with illustrated view of air flow within the air channels.

FIG. 8 illustrates an example of a partial engine crank 830 with illustrated view of air flow within the air channels 833. Shown in FIG. 8 is a piston 810, a connecting rod 820, a fly wheel web 860, a stator web 840. FIG. 8 also indicates an approximate area where high pressure (marked by the letter H) and low pressure (marked by the letter L) exist within the engine crank 830. Although the air channels 833 are shown as having uniform cross-sections, one skilled in the art would understand that the air channels could include non-uniform cross-sections.

Figure 9:
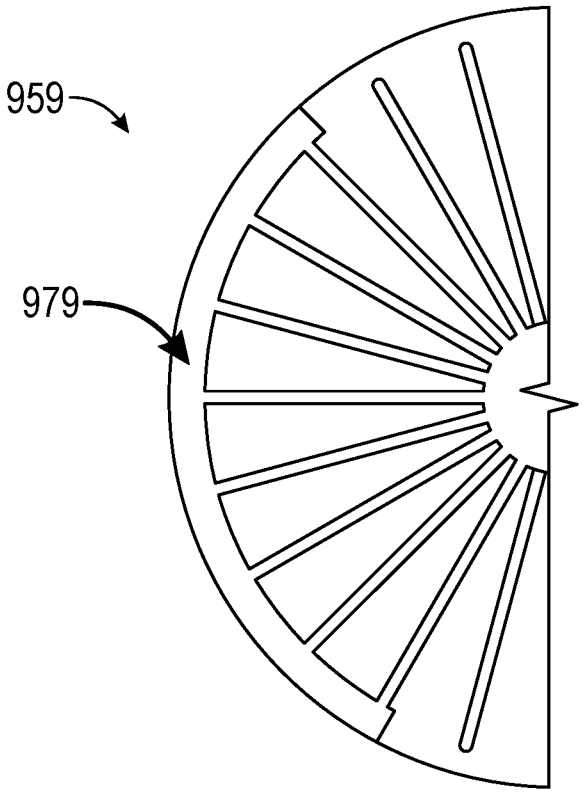
FIG. 9 illustrates an example close-up side-view of a crank web chamber.

FIG. 9 illustrates an example close-up side-view 959 of a crank web chamber 979. In one example, the close-up side-view 959 also illustrates several shortened air channel 433 (as shown in FIG. 4). One skilled in the art would understand that the quantity of shortened air channel 433 illustrated in FIG. 9 may differ from the quantity of shortened air channel 433 illustrated in FIG. 4 since quantities of shortened air channel 433 may vary and still be within the spirit and scope of the present disclosure. In one example, the crank web chamber 979 is of the same configuration as the crank web chamber 479 shown in FIG. 4.

Figure 10:
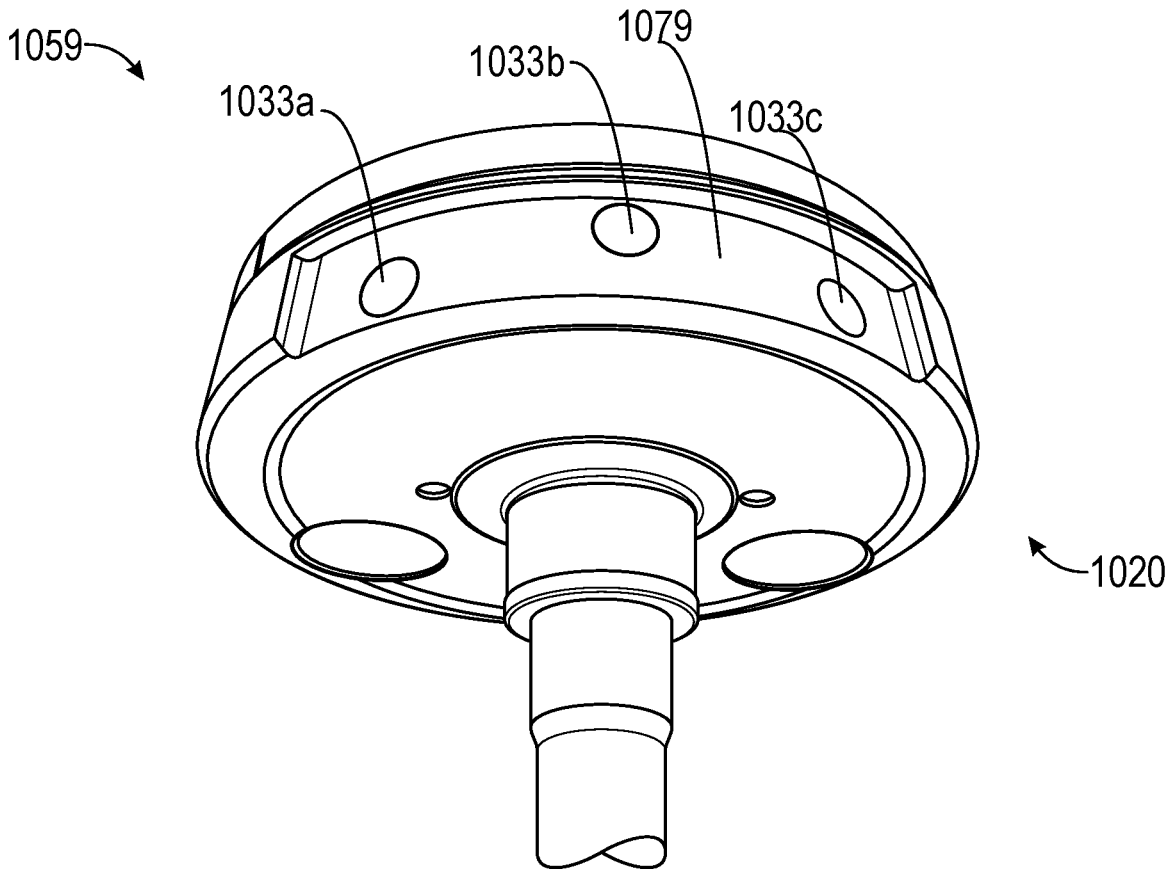
FIG. 10 illustrates an example perspective view of a half engine crank with the crank web chamber exposed.

FIG. 10 illustrates an example perspective view 1059 of a half engine crank 1020 with the crank web chamber 1079 exposed. In the example of FIG. 10, three shortened air channels 1033 are shown. In the example of FIG. 10, the three shortened air channels 1033*a*, 1033*b*, 1033*c* are not on the same radial plane. Shortened air channels 1033*a* and 1033*c* are on the same radial plane, but shortened air channel 1033*b* is on a different radial plane as that of the shortened air channels 1033*a* and 1033*c*.

Figure 11:
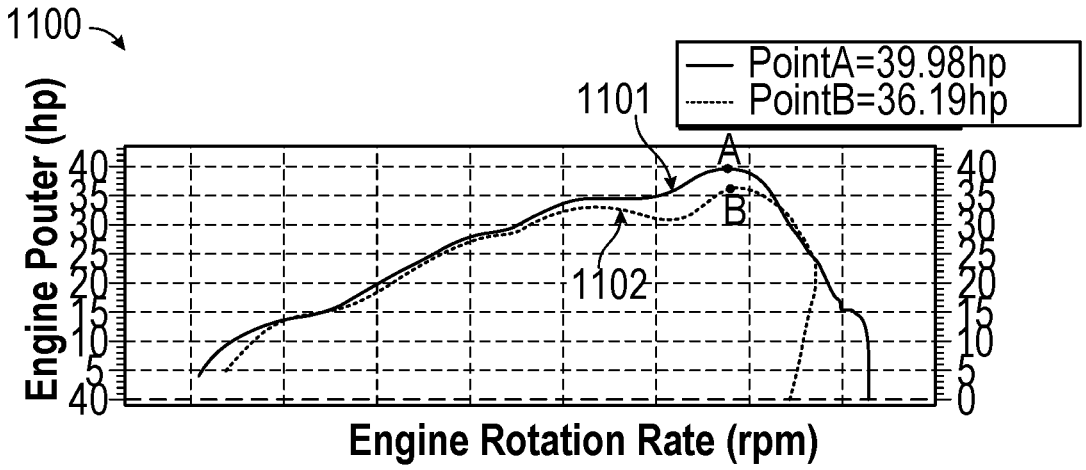
FIG. 11 illustrates an example engine performance graph, engine power measured in horsepower, hp.

FIG. 11 illustrates an example engine performance graph 1100, engine power measured in horsepower, hp. For example, a first graph line 1101 shows engine power (hp) versus engine rotation rate (rpm) for an engine with an engine crank with a plurality of air channels (e.g., 333 shown in FIG. 3, 433 shown in FIG. 4, 633 shown in FIG. 6, 733 shown in FIGS. 7 and 833 shown in FIG. 8). For example, a second graph line 1102 shows engine power (hp) versus engine rotation rate (rpm) for an engine with no air channels. Graph line 1101 shows a peak engine power of 39.98 hp at point A while graph line 1102 shows a peak engine power of 36.19 hp at point B with the same engine rotation rate (rpm) as that of graph line 1101. Thus, graph line 1101 shows an improved engine performance with an engine crank with air channels over an engine crank without air channels.

KJ: The original graph in FIG. 11 has the text "max power=36.19 at engine rpm=8.81" and "max power drum 1=39.93 at engine rpm=8.78". Can you explain the text versus the two max points A and B which shows 39.98 hp and 36.19 hp, respectively.

KJ . . . please look at FIG. 11 being sent to you.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. An engine crank comprising:

a first web, wherein the first web includes a first plurality of air channels, wherein each of the first plurality of air channels includes a first inlet and a first outlet; and a second web coupled to the first web, wherein the second web includes a second plurality of air channels, wherein each of the second plurality of air channels includes a second inlet and a second outlet.

2. The engine crank of claim 1, wherein each of the first plurality of air channels is equidistant from one another, and wherein each of the second plurality of air channels is equidistant from one another.

3. The engine crank of claim 2, wherein each of the first plurality of air channels includes a first length and a first uniform cross-sectional area throughout the first length.

4. The engine crank of claim 3 wherein each of the second plurality of air channels includes a cross-sectional area of one of the following: a square, a rectangle, a circle or an oval.

5. The engine crank of claim 3, wherein each of the second plurality of air channels includes a second length and a second uniform cross-sectional area throughout the second length.

6. The engine crank of claim 2 wherein each of the first plurality of air channels includes a first length and a first non-uniform cross-sectional area throughout the first length.

7. The engine crank of claim 6, wherein each of the second plurality of air channels includes a second length and a second non-uniform cross-sectional area throughout the second length.

8. The engine crank of claim 6, wherein the first non-uniform cross-sectional area is largest near an outer perimeter of the engine crank and smallest near a crank axis.

9. The engine crank of claim 7, wherein the second non-uniform cross-sectional area is largest near an outer perimeter of the engine crank and smallest near a crank axis.

10. The engine crank of claim 2 wherein each of the first plurality of air channels includes a cross-sectional area of one of the following: a square, a rectangle, a circle or an oval.

11. A two-stroke engine, comprising:

a piston;

a combustion chamber configured to house the piston;

an engine crank, wherein the engine crank is coupled to the piston; and an engine crank chamber configured to house the engine crank; and wherein the engine crank comprises:

a first web, wherein the first web includes a first plurality of air channels, wherein each of the first plurality of air channels includes a first inlet and a first outlet; and a second web coupled to the first web, wherein the second web includes a second plurality of air channels, wherein each of the second plurality of air channels includes a second inlet and a second outlet.

12. The two-stroke engine of claim 11, wherein each of the first plurality of air channels is equidistant from one another, and wherein each of the second plurality of air channels is equidistant from one another.

13. The two-stroke engine of claim 12, wherein each of the first plurality of air channels includes a first length and a first uniform cross-sectional area throughout the first length.

14. The two-stroke engine of claim 13 wherein each of the second plurality of air channels includes a cross-sectional area of one of the following: a square, a rectangle, a circle or an oval.

15. The two-stroke engine of claim 13, wherein each of the second plurality of air channels includes a second length and a second uniform cross-sectional area throughout the second length.

16. The two-stroke engine of claim 12 wherein each of the first plurality of air channels includes a first length and a first non-uniform cross-sectional area throughout the first length.

17. The two-stroke engine of claim 16, wherein each of the second plurality of air channels includes a second length and a second non-uniform cross-sectional area throughout the second length.

18. The two-stroke engine of claim 16, wherein the first non-uniform cross-sectional area is largest near an outer perimeter of the engine crank and smallest near a crank axis.

19. The two-stroke engine of claim 17, wherein the second non-uniform cross-sectional area is largest near an outer perimeter of the engine crank and smallest near a crank axis.

20. The two-stroke engine of claim 12 wherein each of the first plurality of air channels includes a cross-sectional area of one of the following: a square, a rectangle, a circle or an oval.

* * * * *